US010624463B2

(12) United States Patent
Rawls-Meehan

(10) Patent No.: US 10,624,463 B2
(45) Date of Patent: Apr. 21, 2020

(54) ADJUSTABLE BED WITH FOUNDATION SPRING SUPPORT

(71) Applicant: ASCION, LLC, Bloomfield Hills, MI (US)

(72) Inventor: Martin B. Rawls-Meehan, Birmingham, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 233 days.

(21) Appl. No.: 15/585,474

(22) Filed: May 3, 2017

(65) Prior Publication Data

US 2017/0318977 A1 Nov. 9, 2017

Related U.S. Application Data

(60) Provisional application No. 62/331,538, filed on May 4, 2016.

(51) Int. Cl.

| | |
|---|---|
| ***A47C 20/04*** | (2006.01) |
| ***A47C 27/00*** | (2006.01) |
| ***A61G 7/015*** | (2006.01) |
| ***A61G 13/08*** | (2006.01) |
| ***A47C 27/14*** | (2006.01) |

(52) U.S. Cl.

CPC ..... *A47C 20/041* (2013.01); *A47C 27/00* (2013.01); *A47C 27/14* (2013.01); *A61G 7/015* (2013.01); *A61G 13/08* (2013.01)

(58) Field of Classification Search

CPC ..... A61G 7/002; A61G 7/005; A61G 7/012; A61G 7/015; A61G 7/018; A61G 13/02; A61G 13/04; A61G 13/06; A61G 13/08; A47C 20/04; A47C 20/041; A47C 20/08; A47C 27/001

USPC ..... 5/618, 613, 616, 617, 716

See application file for complete search history.

(56) References Cited

U.S. PATENT DOCUMENTS 1,550,462 A * 8/1925 Sisbower et al. ..... A61G 7/015 5/618
4,033,567 A * 7/1977 Lipfert ..... A42B 3/12 267/151
4,380,838 A * 4/1983 Lutchansky ..... A47C 1/143 5/613
4,559,656 A * 12/1985 Foster ..... A61G 7/0573 5/236.1

(Continued)

*Primary Examiner* — Robert G Santos

(74) *Attorney, Agent, or Firm* — Marshall, Gerstein & Borun LLP

(57) ABSTRACT

The disclosure relates to an adjustable bed and foundation thereof, in particular incorporating springs or other support elements into the adjustable bed foundation or frame. The adjustable bed can include one or more foundation spring support sections mounted on or in a mattress support surface of the bed foundation. Spring support sections having different firmness levels in different mattress support sections can provide a varying support level to a user of the adjustable bed foundation combined with a mattress thereon. Spring support sections that are discrete from each other can permit articulation of the corresponding mattress support surface sections without creating bending, elongation, and/or compression stresses which might otherwise cause uneven support from or damage to a continuous spring support element spanning multiple mattress support surface sections.

13 Claims, 4 Drawing Sheets

(56) References Cited

U.S. PATENT DOCUMENTS 4,679,266 A * 7/1987 Kraft ..... A47C 27/00 5/716
5,740,574 A * 4/1998 Piraino ..... A47C 27/001 5/716
5,868,383 A * 2/1999 Codos ..... B68G 9/00 267/166.1
6,763,536 B2 * 7/2004 Dewert ..... A47C 20/041 5/616
7,321,811 B1 1/2008 Rawls-Meehan
7,465,280 B2 12/2008 Rawls-Meehan
7,484,257 B2 * 2/2009 Schneider ..... A47C 20/041 5/613
7,805,785 B2 10/2010 Rawls-Meehan
7,930,783 B2 4/2011 Rawls-Meehan
7,933,669 B2 4/2011 Rawls-Meehan
7,979,169 B2 7/2011 Rawls-Meehan
8,019,486 B2 9/2011 Rawls-Meehan
8,032,263 B2 10/2011 Rawls-Meehan
8,032,960 B2 10/2011 Rawls-Meehan
8,046,114 B2 10/2011 Rawls-Meehan
8,046,115 B2 10/2011 Rawls-Meehan
8,046,116 B2 10/2011 Rawls-Meehan
8,046,117 B2 10/2011 Rawls-Meehan
8,050,805 B2 11/2011 Rawls-Meehan
8,069,512 B2 12/2011 Rawls-Meehan
8,078,336 B2 12/2011 Rawls-Meehan
8,078,337 B2 12/2011 Rawls-Meehan
8,150,562 B2 4/2012 Rawls-Meehan
8,375,488 B2 2/2013 Rawls-Meehan
8,464,373 B2 * 6/2013 Wranne ..... A47C 23/061 5/191
8,565,934 B2 10/2013 Rawls-Meehan
8,682,457 B2 3/2014 Rawls-Meehan
2003/0079290 A1 * 5/2003 Dewert ..... A47C 20/041 5/618
2005/0120481 A1 * 6/2005 Farmont ..... A47C 20/041 5/618
2012/0057685 A1 3/2012 Rawls-Meehan
2017/0318977 A1 * 11/2017 Rawls-Meehan .... A47C 20/041

* cited by examiner

ADJUSTABLE BED WITH FOUNDATION SPRING SUPPORT

CROSS REFERENCE TO RELATED APPLICATION

Priority is claimed to U.S. Provisional Application No. 62/331,538 filed on May 4, 2016, which is incorporated by reference herein in its entirety.

STATEMENT OF GOVERNMENT INTEREST

None.

BACKGROUND OF THE DISCLOSURE

Field of the Disclosure

The disclosure generally relates to an adjustable bed, in particular incorporating springs or other support elements into the adjustable bed foundation or frame. In various embodiments, an adjustable bed can include one or more foundation spring support sections mounted on or in a mattress support surface of the adjustable bed foundation. Spring support sections having different firmness levels in different mattress support sections can provide a varying support level to a user of the adjustable bed foundation combined with a mattress thereon.

SUMMARY

In one aspect, the disclosure relates to an adjustable bed comprising: (a) a mattress support surface comprising (i) a first deck support section, and (ii) a second deck support section pivotally attached to the first deck support section; (b) a foundation spring support comprising (i) a first spring support section disposed on an upper surface of the first deck support section of the mattress support, and (ii) a second spring support section disposed on an upper surface of the second deck support section of the mattress support; and (c) a mattress positioned above the foundation spring support.

In another aspect, the disclosure relates to an adjustable bed foundation comprising: (a) a mattress support surface comprising (i) a first deck support section, and (ii) a second deck support section pivotally attached to the first deck support section; and (b) a foundation spring support comprising at least one of (i) a first spring support section disposed on an upper surface of the first deck support section of the mattress support, and (ii) a second spring support section disposed on an upper surface of the second deck support section of the mattress support. In an alternative embodiment, the disclosure relates to a fixed bed foundation (a) a mattress support surface comprising at least one of (i) a first deck support section, and (ii) a second deck support section fixedly attached attached to the first deck support section; and (b) a foundation spring support comprising at least one of (i) a first spring support section disposed on an upper surface of the first deck support section of the mattress support, and (ii) a second spring support section disposed on an upper surface of the second deck support section of the mattress support. A corresponding fixed bed or adjustable bed can further include a mattress positioned above the foundation spring support.

Various refinements of the disclosed bed and foundation with a foundation spring support are possible.

In a refinement, the first spring support section has a first firmness, and the second spring support section has a second firmness that is different from the first firmness. In a further refinement, the mattress has a uniform firmness.

In another refinement, the first spring support section has a first firmness, and the second spring support section has a second firmness that is the same as the first firmness.

In another refinement, the first spring support section is discrete from the second spring support section. In a further refinement, the bed or foundation comprises a flexible containment border mounted to the upper surface of the first deck support section and the second deck support section of the mattress support; wherein the flexible containment border extends around at least a portion of the mattress support periphery and across the mattress support interior, thereby defining two or more interior volumes where the first spring support section and the second spring support section are positioned.

In another refinement, the bed or foundation comprises a flexible containment border mounted to the upper surface of the first deck support section and the second deck support section of the mattress support; wherein the flexible containment border extends around at least a portion of the mattress support periphery, thereby defining one or more interior volumes where the first spring support section and the second spring support section are positioned.

In another refinement, the first spring support section and the second spring support section each independently comprises a spring element selected from the group consisting of a mattress spring, a memory foam element, an air bladder, a foam spring, pluralities thereof, and combinations thereof. In a further refinement, the first spring support section and the second spring support section each comprises a mattress spring or a plurality thereof. In a further refinement, the first spring support section and the second spring support section each comprises a memory foam element or a plurality thereof. In a further refinement, the first spring support section and the second spring support section each comprises an air bladder or a plurality thereof. In a further refinement, the first spring support section and the second spring support section each comprises a foam cell or a plurality thereof.

In another refinement, the mattress support surface further comprises (iii) a third deck support section pivotally attached to the second deck support section, and (iv) optionally a fourth deck support section pivotally attached to the third deck support section; and the foundation spring support further comprises (iii) a third spring support section disposed on an upper surface of the third deck support section of the mattress support, and (ii) a fourth spring support section disposed on an upper surface of the fourth deck support section of the mattress support, when present. In a further refinement, the first spring support section has a first firmness; the second spring support section has a second firmness that is different from the first firmness; the third spring support section has a third firmness that is different from at least one of the first firmness and the second firmness (e.g., one or both), and the fourth spring support section, when present, has a fourth firmness that is different from at least one of the first firmness, the second firmness, and the third firmness (e.g., any, some, or all). In a further refinement, the first spring support section, the second spring support section, the third spring support section, and the fourth spring support section, when present, have the same firmness.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

Figure 1:
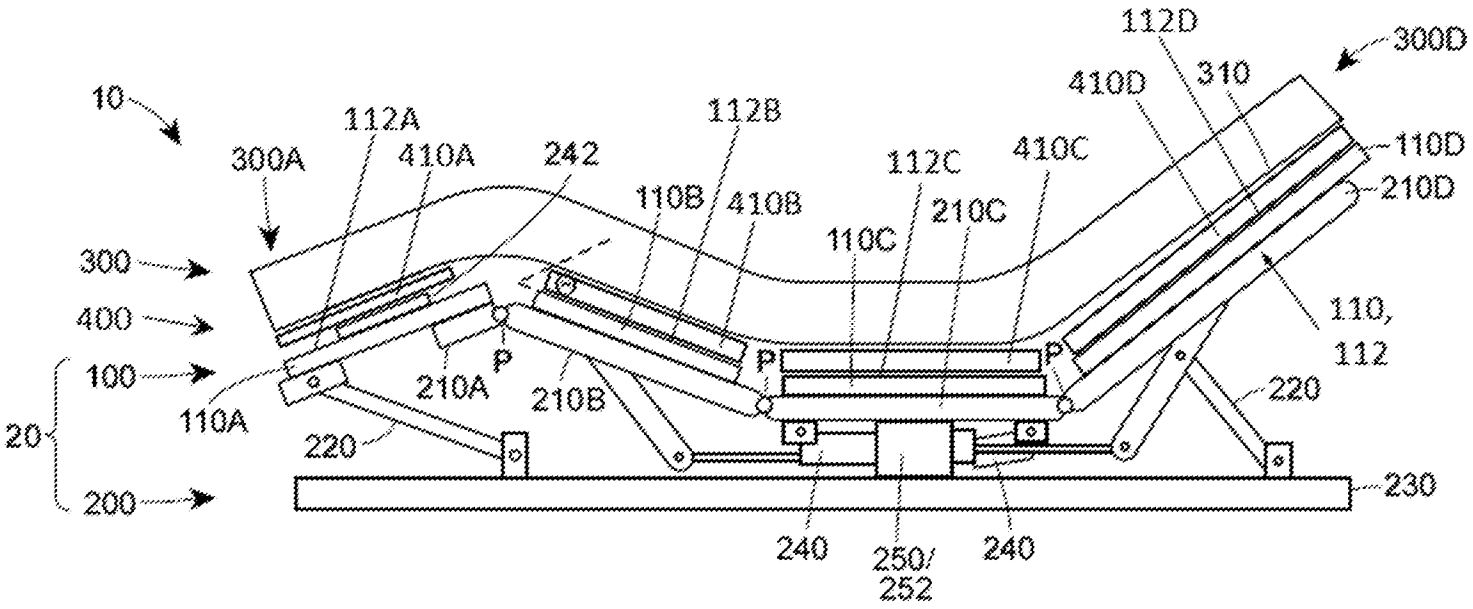
FIG. 1 is a side view of an adjustable bed including an adjustable foundation and a mattress according to the disclosure.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to a bed and foundation thereof, in particular incorporating springs or other support elements into the bed foundation or frame, for example an adjustable bed foundation or frame. In various embodiments, a bed can include one or more foundation spring support sections mounted on or in a mattress support surface of the adjustable bed foundation. Spring support sections having different firmness levels in different mattress support sections can provide a varying support level to a user of the bed foundation combined with a mattress thereon. Spring support sections that are discrete from each other can permit articulation of the corresponding mattress support surface sections in an adjustable bed foundation without creating bending, elongation, and/or compression stresses which might otherwise cause uneven support from or damage to a continuous spring support element spanning multiple mattress support surface sections. Inclusion of a flexible containment border for the spring support sections can provide an aesthetic cover of interior adjustable bed structure as well as a flexible support in interior regions not covered by the spring support sections.

When a consumer uses a mattress and foundation, his/her level of support has traditionally been limited to the support level of their mattress. The present disclosure allows the consumer to have greater levels of support by adding support springs to a bed foundation, for example an adjustable bed foundation or a fixed bed foundation. Further, one embodiment of the disclosure allows for different zones of support to be created, whereby each zone has a different support level that is created by using springs of different firmness levels in different sections of the foundation. In an embodiment, a bed foundation is manufactured such that one or more sections of the foundation are filled with support springs in order to offer extra support for a mattress and the user. In another embodiment, a bed foundation is manufactured such that two or more sections of the foundation are filled with support springs, with each section being comprised of springs of varying support levels, such that each section of the foundation can offer the user a different and unique level of support and comfort. In another embodiment, a bed foundation is manufactured such that support springs are placed on top of the foundation in one or more sections of the foundation in order to offer extra support for a mattress and the user. In another embodiment, a bed foundation is manufactured such that support springs are placed on top of the foundation in two or more sections of the foundation, with each section having springs of varying support levels, such that each section of the foundation can offer the user a different and unique level of support and comfort.

Figure 2:
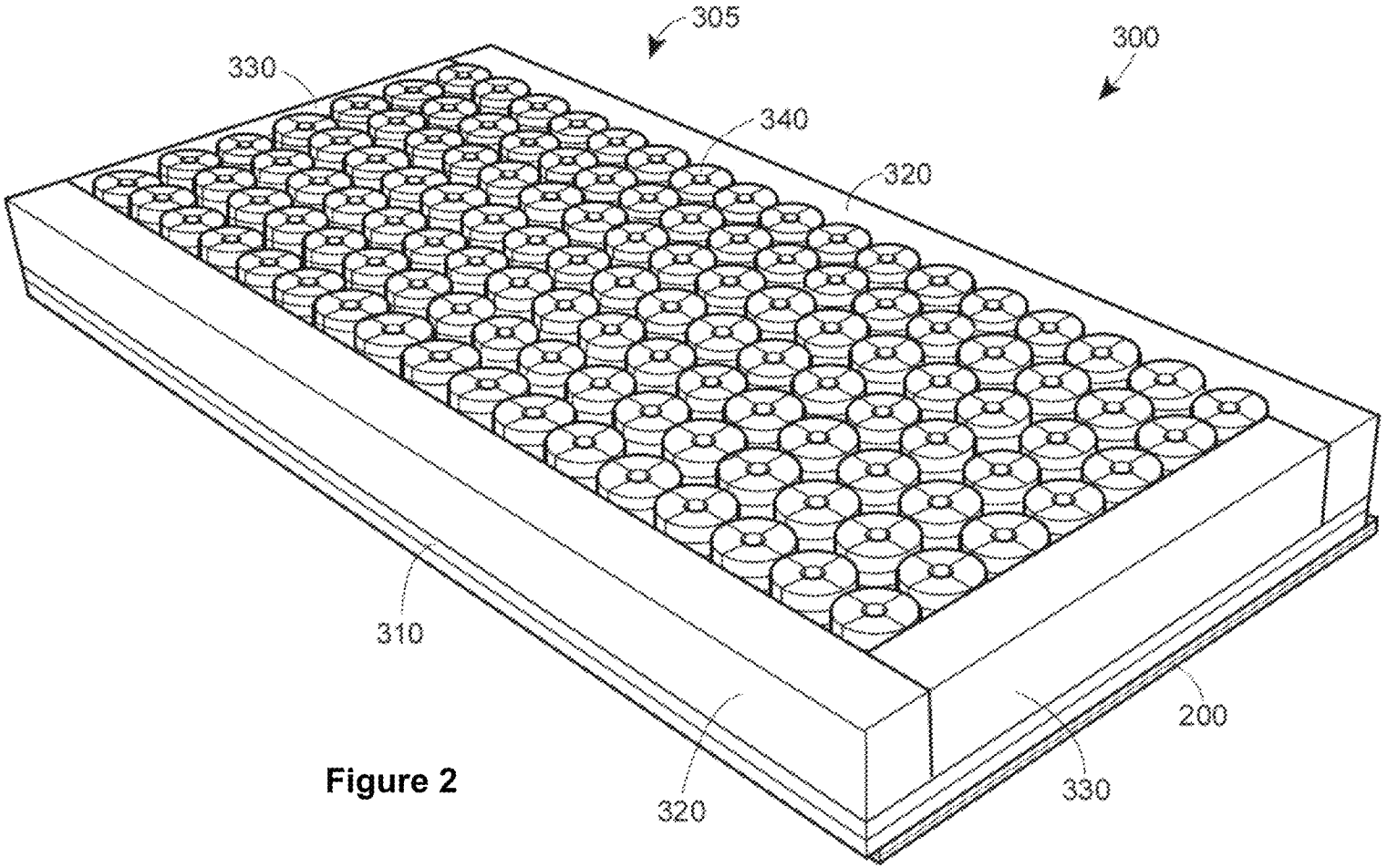
FIG. 2 is a top perspective illustration of a mattress according to the disclosure.

FIG. 1 is a side view of an adjustable bed 10 according to the disclosure. The illustrated adjustable bed 10 includes an adjustable foundation 20 (e.g., adjustable bed foundation), and a mattress 300 sitting atop the adjustable foundation 20. The adjustable foundation 20 can include a mattress support (or deck) 100 mounted to an adjustable frame 200, and a foundation spring support 400 disposed on the mattress support 100 upon which the mattress 300 sits. FIG. 2 is a top perspective illustration of a mattress 300 according to the disclosure.

The mattress support 100 includes a deck support 110 platform, for example including a plurality of deck support sections 110A-110D as illustrated. A deck support platform 110 formed from a plurality of deck support sections 110A-110D, each having a corresponding upper surface 112A-112D (i.e., the surface which supports the mattress 300, such as directly or indirectly via the intervening foundation spring support 400) is suitable for the adjustable foundation 20. In the illustrated embodiment, section 110A corresponds to the foot portion of the bed, section 110B corresponds to the leg portion of the bed, section 110C corresponds to the bottom portion of the bed, and section 110D corresponds to the head and neck portion of the bed 10 (i.e., where the sections correspond to the body portion of a user laying on the bed 10/mattress 300 in a normal use orientation). Each section 110A-110D includes longitudinally opposed ends 110$A_1$ and 110$A_2$, 110$B_1$ and 110$B_2$, 110$C_1$ and 1100$_2$, 110$D_1$ and 110$D_2$, respectively, where the longitudinal direction Y is generally defined as being perpendicular to the pivot axis P (described below) and/or along the mattress support 100 length or mattress 300 length. Each deck support section 110A-110D can be pivotally attached to one or more adjacent sections (e.g., directly or indirectly via underlying frame 200 structure as described below), thus allowing each section 110A-110D to rotate independently around the lateral pivot axis P (e.g., an axis generally in the lateral direction X and perpendicular to the longitudinal direction Y). The mattress support 100 generally includes at least two deck support sections, for example including a first (foot) support section 110A, a second (leg) support section 110B pivotally attached to the first section 110A, a third (bottom) support section 110C pivotally attached to the second section 110B, and a fourth (head/neck) support section 110D pivotally attached to the third section 110C as shown in FIG. 1. In other embodiments (not shown), the mattress support 100 can have fewer or more support sections (e.g., a first (foot) support section, a second (leg and bottom) support section pivotally attached thereto, and a third (head/neck) support section pivotally attached thereto). In some embodiments, the support sections 110A-110D can be formed from a rigid support material such as wood or metal. In other embodiments, the support sections 110A-110D can be formed from a flexible fabric or padding material (e.g., alone or in combination with a rigid support material, such as a cover or padding for an underlying rigid support material).

The adjustable frame 200 generally provides the mechanical, electrical, and electronic support and articulation components for the adjustable foundation 20 and bed 10. As illustrated, the adjustable frame 200 includes a frame support 210, for example including a plurality of frame support sections 210A-210D as illustrated and corresponding to the deck support sections 110A-110D. Each deck support section 110A-110D can be fixedly or removably mounted (e.g., via bolts, screws, or other fastener or adhesive components) to its underlying frame support section 210A-210D such that when one or more frame support sections 210A-210D are articulated, the deck support sections 110A-110D are correspondingly articulated. As illustrated, each frame support section 210A-210D can be pivotally attached at a pivot axis P to one or more adjacent sections (e.g., directly as illustrated and providing an indirect pivotal attachment for corresponding deck support sections), thus allowing each section 210A-210D to rotate independently around the lateral pivot axis P. The adjustable frame 200 generally includes at least two frame support sections, for example including a first (foot) support section 210A, a second (leg) support section 210B pivotally attached to the first section 210A, a third (bottom) support section 210C pivotally attached to the second section 210B, and a fourth (head/neck) support section 210D pivotally attached to the third section 210C as shown in FIG. 1. In other embodiments (not shown), the adjustable frame 200 can have fewer or more frame support sections (e.g., a first (foot) support section, a second (leg and bottom) support section pivotally attached thereto, and a third (head/neck) support section pivotally attached thereto).

As illustrated, the adjustable frame 200 further includes a subframe 230, for example a rigid, non-articulatable frame structure which sits on a floor or within a decorative bed frame common in the furniture industry such as a platform bed (e.g., via various leg elements, not shown) and provides stability for the bed foundation 20 as the adjustable frame 200 is articulated to various different positions. The adjustable frame 200 can further include one or more support members 220 connecting structure between the subframe 230 and the frame support 210 and sections 210A-210D thereof. In some embodiments, one or more of the frame sections 210A-210D can be fixed in position relative to the subframe 230 (e.g., bottom section 210C as illustrated) and be unable to rotate or articulate relative to the subframe 230, although other frame sections pivotally attached thereto are able to rotate or articulate. As further illustrated, the adjustable frame 200 can include peripheral components such as one or more actuators 240 (e.g., including a corresponding motor and actuator rod) variously mounted to one or more of the subframe 230, a support member 220, and a frame support section 210A-210D. Similarly, the foundation 20 can include a peripheral component such as a vibration or massage motor 242 mounted to a component of the foundation 20, such as the mattress support 100 (e.g., a deck support section 110 as illustrated) or to the frame 200, which motor can provide massage functionality to one or more sections of the mattress 300. In some embodiments, the subframe 230, the support members 220, and the frame support sections 210A-210D can be formed from metal such as steel. The actuators 240 can be any of those commonly known in the art. The actuators 240 and, correspondingly, the configuration or position of the adjustable frame 200, mattress support 100, foundation spring support 400, and mattress 300 can be controlled and adjusted by a suitable power supply 250, an adjustable bed controller or control box 252 (e.g., programmable logic controller or otherwise), and a remote control to deliver repositioning commands. The power supply 250 can be mounted to a support structure of the adjustable bed 10 such as the frame 200 or other foundation 20 component, and it is adapted to receive a continuous source of input power (e.g., alternating current such as mains power supply at about 110V, 120V, 220V, 230V, or 240V and/or at about 50 Hz or 60 Hz), and it is adapted to deliver a direct current (DC) source of output power at a specified or otherwise relatively consistent delivery voltage (e.g., the power supply can be a standard AC-to-DC converter). The output delivery voltage from the power supply suitably is 24V or 36V DC. The controller/control box 252 is adapted to wirelessly receive (and optionally transmit for feedback control) a position control signal for adjusting the position of one or more deck support sections 110 via a suitable wireless protocol such as general radio frequency (RF), WIFI (e.g., IEEE 802.11 standard), or BLUETOOTH (e.g., UHF RF signal in the 2.4-2.485 GHz range) protocols. The controller/control box 252 can be mounted to the adjustable bed 10 such as on the foundation 20, frame 200, or component thereof. The remote control similarly is adapted to wirelessly transmit (and optionally receive for feedback control) the position control signal to the controller/control box 252 via one or more suitable wireless protocols complementary to those of the controller/control box 252.

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. In the illustrated embodiment, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material (e.g., a non-woven fabric material). The mattress 300 is generally positioned above the mattress support 100 surface 112 and above the foundation spring support 400, for example sitting directly atop spring support sections 410. In other embodiments, other structure between the mattress 300, the mattress support 100 surface 112, and/or the foundation spring support 400 can be present, for example a padding or cushion material between the mattress 300 and the foundation spring support 400 and/or between the mattress 300 and the mattress support 100 surface 112.

Figure 3:
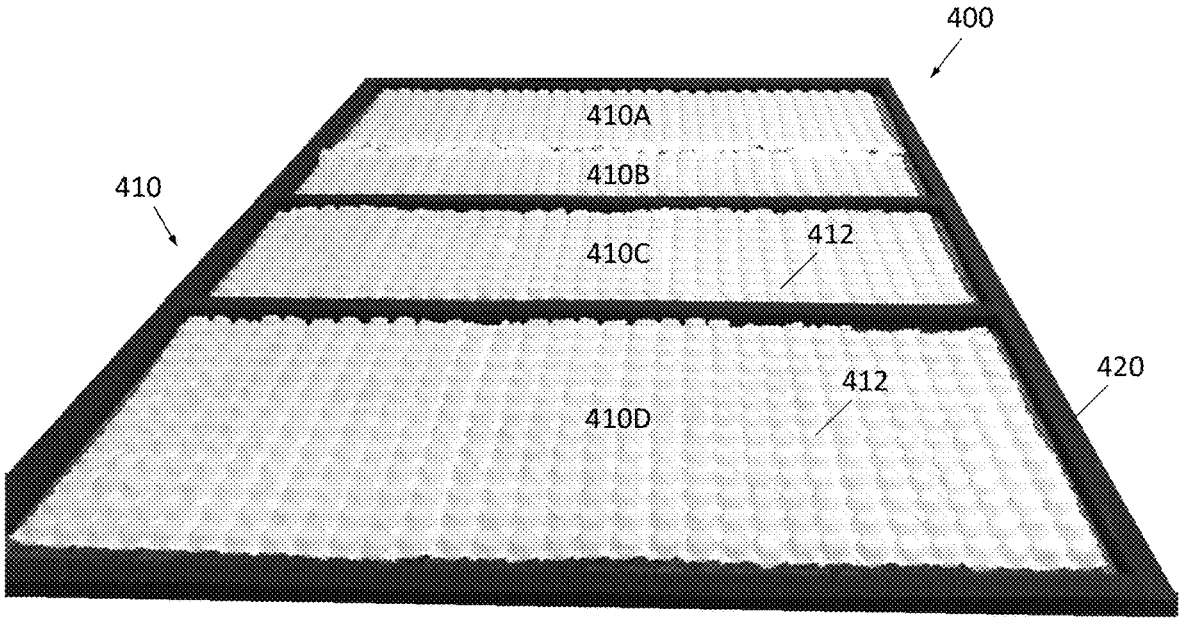
FIG. 3 illustrates a top front perspective view of a foundation spring support according to the disclosure.
Figure 4:
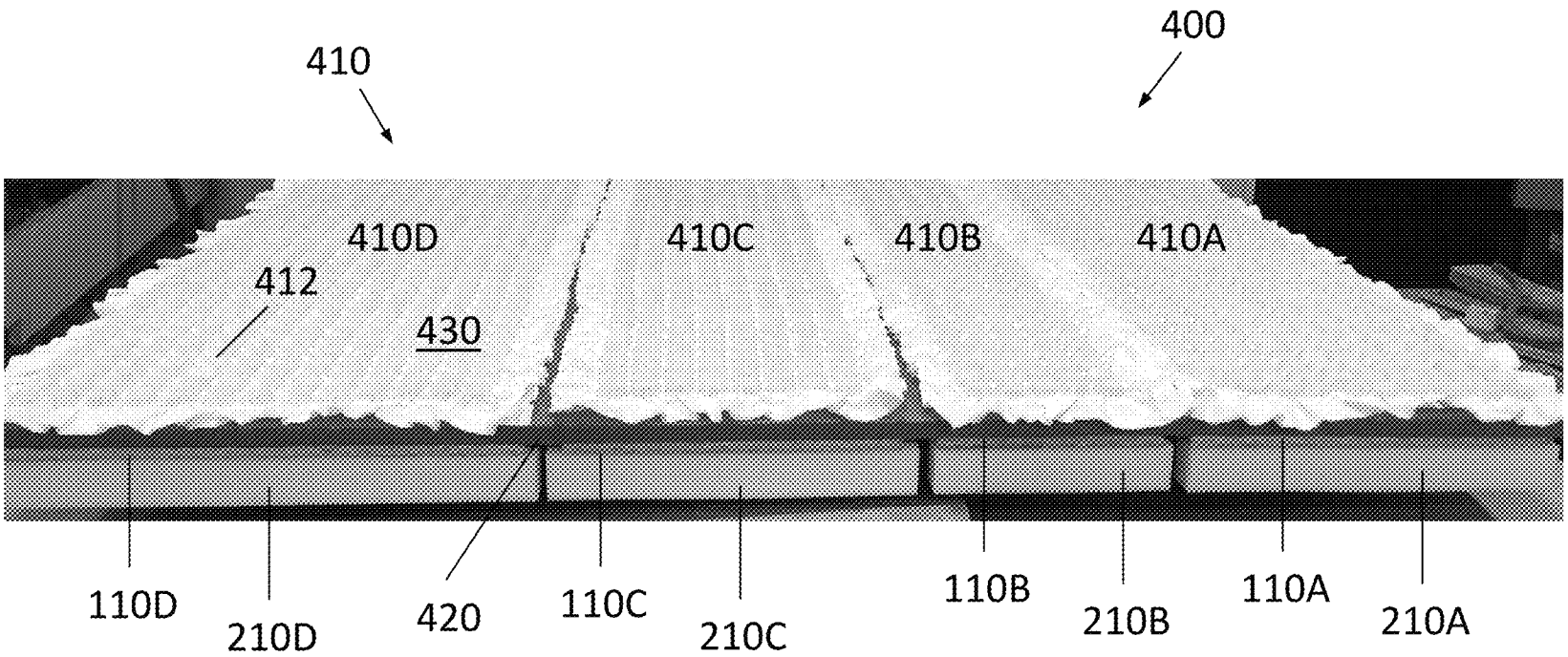
FIG. 4 illustrates a top side perspective view of an adjustable bed foundation including a foundation spring support according to the disclosure.

FIGS. 1, 3, and 4 illustrate an adjustable bed 10 and foundation 20 including a foundation spring support 400 according to the disclosure. The foundation spring support 400 includes one or more spring support sections 410, for example including four spring support sections 410A-410D corresponding to the foot, leg, bottom, and back/head portions, respectively, of the bed 10/foundation 20 as illustrated. As illustrated, each of the spring support sections 410A-410D is disposed on an upper surface 112A-112D of a corresponding deck support section 110A-110D. In other embodiments, only one or fewer than all of the deck support sections 110 can have a corresponding spring support section 410 thereon. The spring support sections 410 can be fixedly or removably mounted (e.g., via bolts, screws, or other fastener or adhesive components, such as hook-and-loop fasteners) to their underlying deck support section 110, or they may be simply sitting on the underlying deck support sections 110, held in place for example by a containment border. The mattress 300 is generally positioned above the foundation spring support 400, for example where the outer bottom mattress 300 surface is disposed above or on the foundation spring support 410/sections 410 (e.g., removably placed on the foundation spring support 400 but not otherwise attached thereto or an integral component thereof).

Each spring support section 410 has a characteristic firmness (e.g., firmness or support value or level) relating to its ability to provide a deformable support surface to a user on the bed 10 (e.g., atop the mattress 300 which is in turn atop the foundation spring support 400). The firmness of each spring support section 410 can be selected (e.g., based on the spring elements used to form the spring support section 410) to be the same or different as the firmness of other spring support sections 410 in the bed 10/foundation 20. In some embodiments, the spring support sections 410 have varying firmness levels such that different sections of the bed 10/foundation 20 (e.g., foot, leg, bottom, and back/head portions thereof) provide a variable, user-selected degree of support and comfort. In some cases, the mattress 300 can have a uniform firmness across its entire support surface, in which case a customized, spatially variable degree of support and comfort of the bed 10 as a whole still can be provided to the user via the varying firmness levels of the underlying spring support sections 410. In some embodiments, the spring support sections 410 have the same firmness levels such that the foundation spring support 400 provides a uniform level of support to the bed 10/foundation 20.

In some embodiments, multiple spring support sections 410 in the foundation spring support 400 are discrete structures from each other. For example, the spring support sections 410 are separate, spaced apart structures, such as where there is a space or gap between adjacent spring support sections 410 at a pivot location P between the corresponding deck support sections 110. Such separate, discontinuous spring support sections 410 for corresponding deck support sections 110 allows the deck support sections 110 to articulate/rotate without creating the bending stresses at the pivot locations P, which might otherwise cause a continuous spring support element spanning such a pivot location P to bow or lift off from its deck support 100 and/or damage the internal spring support elements 412 due to excessive elongation or compression.

In some embodiments, the foundation spring support 400 further includes a flexible containment border 420 mounted to the upper surfaces 112 of the deck support sections 110. The flexible containment border 420 can be fixedly or removably mounted (e.g., via bolts, screws, or other fastener or adhesive components, such as hook-and-loop fasteners) to its underlying deck support sections 110. The flexible containment border 420 extends around at least a portion of the mattress support 100/deck support 110 periphery, thereby defining one or more interior volumes 430 where the spring support sections 410 are positioned. As illustrated, the flexible containment border 420 also can extend laterally across the mattress support 100/deck support 110 interior, thereby defining two or more interior volumes 430. The flexible containment border 420 can be formed from flexible foam and/or fabric. The flexible containment border 420 can be a continuous piece of material that spans the space or gap between adjacent spring support sections 410 and deck support sections 110, thereby providing an aesthetic cover of interior adjustable bed 10 structure that is also able to bend and conform to an articulating bed frame 200.

The spring support sections 410 can be formed from any suitable materials to provide a deformable support surface, for example include any of the various materials to form the support elements in the mattress 300 (e.g., which can be the same or different type of support elements for a given mattress 300/spring support section 410 combination). For example, each spring support section 410 can be formed from one or more spring elements 412 such as mattress springs (e.g., as used in a full spring mattress), memory foam elements (e.g., an appropriately sized component analogous to memory foam materials used in a full memory foam mattress), air bladders (e.g., an appropriately sized component analogous to inflatable bladders used in a full air mattress), and foam springs or foam cells. A given spring support section 410 can include a single large spring element 412 or a plurality of smaller spring elements 412, and the same or different types of spring elements 412 can be used in different spring support sections 410. Individual spring elements 412 within a spring support section 410 can have variable firmness values, and such variable firmness values within the same spring support section 410 can be selected to obtain a desired overall firmness value for the spring support section 410 as a whole, which can be the same or different as the overall firmness value of other spring support sections 410.

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

PARTS LIST

10 adjustable bed (including mattress support 100, adjustable frame 200, mattress 300, and foundation spring support system 400)

20 adjustable foundation (including mattress support 100, adjustable frame 200, and foundation spring support system 400)
100 mattress support (or deck) surface
110 deck support (sections 110A-D as foot, leg, bottom, and back/head portions; longitudinally opposed ends 110$A_1$ and 110$A_2$, 110$B_1$ and 110$B_2$, 110$C_1$ and 110$C_2$, 110$D_1$ and 110$D_2$)
112 top surface of deck support (sections 112A-D as for deck support)
200 adjustable (bed) frame
210 frame support (sections 210A-D as foot, leg, bottom, and back/head portions)
220 support member
230 subframe
240 actuator and motor therefor or movement/articulation means
242 massage/vibration motor
250 power supply (e.g., AC-to-DC converter)
252 adjustable bed controller or control box for sending/receiving bed control commands
300 mattress (300A: foot end; 300D: head end)
305 containment frame
310 base
320 sidewalls
330 endwalls
340 foam cells or foam springs
400 foundation spring support system
410 spring support section (sections 410A-D as foot, leg, bottom, and back/head portions)
412 spring elements
420 flexible containment border
430 interior volume
X (local) lateral direction
Y (local) longitudinal direction
Z (local) normal direction
P pivot axis
Θ angle of articulation between adjacent sections

What is claimed is:

1. An adjustable bed comprising:
(a) a mattress support comprising (i) a first deck support section, and (ii) a second deck support section pivotally attached to the first deck support section;
(b) a foundation spring support comprising (i) a first spring support section disposed on an upper surface of the first deck support section of the mattress support, and (ii) a second spring support section disposed on an upper surface of the second deck support section of the mattress support, wherein the first spring support section is discrete from the second spring support section;
(c) a mattress positioned above the foundation spring support; and
(d) a flexible containment border mounted to the upper surface of the first deck support section and the second deck support section of the mattress support, wherein the flexible containment border extends around at least a portion of the mattress support periphery and across the mattress support interior, thereby defining two or more interior volumes where the first spring support section and the second spring support section are positioned.

2. The adjustable bed of claim 1, wherein:
the first spring support section has a first firmness, and
the second spring support section has a second firmness that is different from the first firmness.

3. The adjustable bed of claim 2, wherein the mattress has a uniform firmness.

4. The adjustable bed of claim 1, wherein:
the first spring support section has a first firmness, and
the second spring support section has a second firmness that is the same as the first firmness.

5. The adjustable bed of claim 1, wherein:
the first spring support section and the second spring support section each independently comprises a spring element selected from the group consisting of a mattress spring, a memory foam element, an air bladder, a foam spring, pluralities thereof, and combinations thereof.

6. The adjustable bed of claim 5, wherein the first spring support section and the second spring support section each comprises a mattress spring or a plurality thereof.

7. The adjustable bed of claim 5, wherein the first spring support section and the second spring support section each comprises a memory foam element or a plurality thereof.

8. The adjustable bed of claim 5, wherein the first spring support section and the second spring support section each comprises an air bladder or a plurality thereof.

9. The adjustable bed of claim 5, wherein the first spring support section and the second spring support section each comprises a foam cell or a plurality thereof.

10. The adjustable bed of claim 1, wherein:
the mattress support further comprises (iii) a third deck support section pivotally attached to the second deck support section, and (iv) optionally a fourth deck support section pivotally attached to the third deck support section; and
the foundation spring support further comprises (iii) a third spring support section disposed on an upper surface of the third deck support section of the mattress support, and (ii) a fourth spring support section disposed on an upper surface of the fourth deck support section of the mattress support, when present.

11. The adjustable bed of claim 10, wherein:
the first spring support section has a first firmness;
the second spring support section has a second firmness that is different from the first firmness;
the third spring support section has a third firmness that is different from at least one of the first firmness and the second firmness, and
the fourth spring support section, when present, has a fourth firmness that is different from at least one of the first firmness, the second firmness, and the third firmness.

12. The adjustable bed of claim 10, wherein the first spring support section, the second spring support section, the third spring support section, and the fourth spring support section, when present, have the same firmness.

13. An adjustable bed foundation comprising:
(a) a mattress support comprising (i) a first deck support section, and (ii) a second deck support section pivotally attached to the first deck support section; and
(b) a foundation spring support comprising (i) a first spring support section disposed on an upper surface of the first deck support section of the mattress support, and (ii) a second spring support section disposed on an upper surface of the second deck support section of the mattress support, wherein the first spring support section is discrete from the second spring support section; and
(c) a flexible containment border mounted to the upper surface of the first deck support section and the second deck support section of the mattress support, wherein the flexible containment border extends around at least a portion of the mattress support periphery and across the mattress support interior, thereby defining two or more interior volumes where the first spring support section and the second spring support section are positioned.

* * * * *